US008915493B2

(12) United States Patent
Keller

(10) Patent No.: US 8,915,493 B2
(45) Date of Patent: Dec. 23, 2014

(54) APPARATUS AND METHOD FOR CONTROLLING THE TRANSPORTATION AND THE HANDLING OF SHEET-LIKE PRODUCTS

(75) Inventor: Roland Keller, Greifensee (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 13/994,591

(22) PCT Filed: Nov. 30, 2011

(86) PCT No.: PCT/EP2011/071405

§ 371 (c)(1),
(2), (4) Date: Jun. 14, 2013

(87) PCT Pub. No.: WO2012/079987

PCT Pub. Date: Jun. 21, 2012

(65) Prior Publication Data

US 2013/0264764 A1 Oct. 10, 2013

(30) Foreign Application Priority Data

Dec. 15, 2010 (CH) ..... 2087/10

(51) Int. Cl.

| | |
|---|---|
| ***B65H 5/22*** | (2006.01) |
| ***B65H 7/20*** | (2006.01) |
| ***B65H 9/12*** | (2006.01) |
| ***B65H 7/02*** | (2006.01) |
| ***B65H 3/00*** | (2006.01) |
| ***B65H 29/02*** | (2006.01) |

(52) U.S. Cl.

CPC .. *B65H 7/02* (2013.01); *B65H 7/20* (2013.01); *B65H 9/12* (2013.01); *B65H 2513/50* (2013.01); *B65H 3/00* (2013.01); *B65H 2511/40* (2013.01); *B65H 29/02* (2013.01); *B65H 2557/12* (2013.01)

USPC ..... 271/3.14; 271/3.16; 271/265.01

(58) Field of Classification Search

USPC ..... 271/3.13, 3.16, 268, 3.14, 265.01

See application file for complete search history.

(56) References Cited

U.S. PATENT DOCUMENTS

| | | | | |
|---|---|---|---|---|
| 2004/0073330 | A1 | 4/2004 | Bader et al. | |
| 2009/0252200 | A1 * | 10/2009 | Dohler et al. | 375/141 |

FOREIGN PATENT DOCUMENTS

| | | | |
|---|---|---|---|
| DE | 102 45 323 | A1 | 4/2004 |
| EP | 0 562 333 | A2 | 9/1993 |
| EP | 0 810 967 | | 8/1996 |
| EP | 0 897 887 | B1 | 2/1999 |
| EP | 1 275 607 | B1 | 1/2003 |

(Continued)

*Primary Examiner* — Michael McCullough
*Assistant Examiner* — Howard Sanders
(74) *Attorney, Agent, or Firm* — Pauley Petersen & Erickson

(57) ABSTRACT

The invention proposes a method and an installation for monitoring and/or controlling at least one handling apparatus for handling a multiplicity of preferably sheet-like products, in particular printed products, each product being assigned a reference (4). The installation comprises a transporting apparatus for transporting the multiplicity of products at a distance apart from one another along a transporting direction to at least one handling apparatus, or past the same, at least one detecting apparatus (1, 1') at least for picking up references of the products and for communicating messages belonging to the references, and at least one processing unit (3) for processing the messages. In at least one delay device (5), a number of messages relating to references (4) from a plurality of products are combined to form a message group (6) and are communicated to the processing unit (3) via a communications medium (2) once a delay period (9) has elapsed.

23 Claims, 2 Drawing Sheets

(56) References Cited

FOREIGN PATENT DOCUMENTS

| | | | |
|---|---|---|---|
| WO | WO 96/26143 | | 8/1996 |
| WO | WO 01/46765 | A1 | 6/2001 |
| WO | WO 2007/012206 | A1 | 2/2007 |
| WO | WO 2008/144945 | A2 | 12/2008 |

* cited by examiner

APPARATUS AND METHOD FOR CONTROLLING THE TRANSPORTATION AND THE HANDLING OF SHEET-LIKE PRODUCTS

BACKGROUND OF THE INVENTION

1. Field of the Invention

The present invention relates to an apparatus and a method for monitoring and/or controlling the transportation and/or the handling of multiple products, preferably for transporting and handling sheet-like products, in particular printed products such as newspapers or magazines, as claimed in the preamble to claims 1 and 15.

2. Discussion of Related Art

When printed products such as, for example, newspapers, magazines, catalogs, brochures and the like, or other sheet-like flexible products, are further processed, they are conveyed along from handling and/or processing systems by a transportation apparatus and thus finished by different handling and/or processing stations of the system. The transportation apparatus generally comprises endless transportation belts or chains, on which grippers or clamps are provided that in each case grip at least one product and convey it along through the system. The products are handled at the handling stations, for example by being folded, pleated, stapled, receiving an insert, being glued, cut, labeled, sorted, collected, packaged or wrapped, wherein products are transported, stored temporarily, separated or branched off between the individual stations at high speed. Capacities of 40,000 to 80,000 copies per hour can be achieved using such systems and transport apparatuses. Such a system is known, for example, from WO 2007/012206 A1.

The transportation apparatus and the individual handling stations are monitored and controlled with the aid of a computer, wherein the individual products or the grippers that grip a product can be marked so that a product or a gripper can be individualized. The marking can be read using suitable reader devices in real time so that it is known at any time where said product is located and the system can be controlled accordingly. Such a monitoring method is described, for example, in WO 2008/144945 A2.

A further method for identifying printed products is known from EP 0 810 967 B1, wherein an identity address is again associated with each gripper. Multiple grippers of a certain chain length of the transportation chain are here combined to form a section and a code is assigned to the section. It is intended that the chain length of a section here is so short with respect to the elasticity of the chain that variations in the chain length of each section compared to the spacing of the grippers can be ignored. It is thus possible to reduce measurement errors which can occur when specifying a gripper, owing to a change in length, for example caused by thermal expansion of the chain, wear on the chain or length tolerances. First the start of a section is determined by the code using a code sensor. Then the number of grippers is counted using a position sensor until the sought gripper has been identified. The sections and the grippers are thus determined in real time with the cycle time of the transportation chain.

In the known methods for producing printed products or other sheet-like flexible products, it is possible for a data bottleneck or overload to occur during the data transmission, owing to the high cycle time of the transportation apparatus and the multiple individual handling stations that need to be provided in each case with data on the identity of a product or a gripper according to the cycle time of the transportation apparatus. This can lead to inaccuracies in conveying and identifying products and hence to errors in product production or even to failure of the production system.

SUMMARY OF THE INVENTION

An object of the present invention is to provide a method and a system for monitoring and/or controlling the transportation and/or the handling of multiple products, preferably sheet-like products, which enable individual products to be identified reliably and without errors and data on the products to be transmitted, work perfectly even at high speeds and product quantities, and guarantee secure conveyance and handling of the products inside the system.

This object is achieved by the invention by a method as claimed in claim 1 and a system as claimed in claim 15. Advantageous embodiments and further exemplary embodiments are described in the subclaims.

In a system and a method for monitoring and/or controlling the transportation and/or the handling of multiple products according to the present invention, each product has a reference or is associated with a specific reference. A transportation apparatus for transporting multiple products, generally at least one handling or processing apparatus, a detection apparatus for at least recording references of the products and for transmitting messages that pertain to the references, and at least one processing unit for processing the messages are provided. Also provided, according to the invention, are at least one time-delay device, which is suitable for combining multiple messages concerning multiple references of multiple products to form a message packet, and a transmission medium, via which the message packet is transmitted to the processing unit after a time delay period has elapsed. A BUS system can, for example, be used as the transmission medium but other topologies are suitable too. The system and the method according to the present invention are suitable in particular for the production and further processing of printed products, as has already been described.

A marker, a tag, or a code can, for example, serve as a reference for a specific product, but so too can a specific retaining means for retaining the product on the transportation apparatus such as, for example, a gripper or a clamp or a marker provided on the gripper. The essential thing is that the respective product can be unambiguously identified and/or located using the reference. The multiple products are conveyed by the transportation apparatus one after the other, preferably spaced apart from one another, in a transportation direction to at least one handling apparatus or past it. For this purpose, the transportation apparatus preferably has an endless transportation chain on which retaining means for releasably retaining the products are or can be arranged, for example in the form of grippers or clamps. The individual grippers are provided at short distances apart from one another along the transportation chain, and the transportation chain is moved at a definable speed that determines the cycle of handling and processing the products through the system. According to other embodiments, the transportation apparatus has one or more single- or double-sided transportation belts, wherein the products conveyed by the transportation belt or the transportation belts are likewise provided with a cycle.

The multiple products are guided by the transportation apparatus past at least one detection apparatus that records references for these products and transmits a message associated with the respective reference to the processing unit.

The message preferably contains information on the identity and the precise position of the referenced product and can also contain a query for information about this product and request a response, for example in the form of a feedback message, from the processing unit. The feedback message can contain, for example, information on the orientation of a product in the gripper, the labeling on an individual product, or the like. According to preferred embodiments, the reference is associated with further information such as, for example, information for combining certain products to form bundles or units with a new cycle, or information on resorting products within a new cycle, or status information such as, for example, information on disabled or blocked handling apparatuses.

According to the invention, multiple messages about references of the products are combined during a time delay period to form a message packet. The number of messages in a message packet here can differ. Between 5 and 100 messages can, for example, be combined. It is also not necessary for messages to be collected continuously over the whole duration of the time delay period. The essential thing is that a message packet in the transmission medium represents a unit and as such can be transmitted by it. The duration of the time delay period is preferably determined not by the number of the messages to be collected or at least not solely by it. The length of the time delay period can here be determined, for example, depending on the working conditions in the transportation apparatus or the handling apparatus. The message packet is transmitted to the processing unit via the transmission medium after the time delay period has elapsed. Similarly, multiple feedback messages, queried by the processing unit by means of a message packet, about information on the multiple, preferably sheet-like products can preferably also be combined as a feedback message packet. Thus a certain message from the message packet is then associated with each feedback message. The feedback message packet can also advantageously be transmitted from the processing unit to the detection apparatus after a further time delay period has elapsed. This feedback message time delay period here does not have to correspond to the message time delay period by which the message packets were delayed.

In the case of the method and the system for transporting and handling multiple products, preferably sheet-like products, such as, for example, newspapers, magazines, brochures, catalogs, and other printed products, according to the present invention it is advantageously possible to wait to transmit information from the products and for the products until data traffic within the transmission medium permits perfect transmission. It is thus possible to wait to send a message packet or a feedback message packet until the the transmission medium is idle. The packets can then be transferred without interruption to and from the processing unit and thus do not disturb any existing data traffic in the transmission medium. As a result, the safety and reliability in the controlling of the transportation apparatus or the handling apparatuses can be optimized, the transportation apparatus can operate at a high cycle frequency, and the handling of the products on the transportation apparatus can be performed exactly. This is crucial, for example, when inserts are added to a newspaper that is guided by a gripper in the transportation apparatus so that a corresponding add-in handling apparatus can deliver the insert accurately, or when the newspaper is folded by a folding handling apparatus so that the folding is carried out at a point predetermined by the layout.

In addition, the volume of data in the transmission medium can be reduced by the use of message packets and feedback message packets. Overloading of the transmission medium and the connected risk of faulty controlling of the system can according to the invention be reliably avoided in a monitoring and control system for producing the preferably sheet-like products.

The handling apparatuses of the system can, for example, be folding, pleating, cutting or binding stations for handling individual or multiple sheets or layers of paper of a product, labeling or inserting stations, separating stations for finished products, or bundling and packing stations. Such stations require information on the identity of the product and its precise position in order to be able to, for example, apply a correct label or correctly insert an item.

A simple reader apparatus with a transmit function can be used as the detection apparatus, such as, for example, conventional optical or capacitative sensors. The detection apparatus is preferably used in the sense of a transfer unit and comprises, for example, a read and write apparatus and can send the message packets to the processing unit and receive the feedback message packets from the latter. The handling apparatus can, for example, be controlled depending on information from the feedback message packets. It is advantageous if each detection apparatus is associated with a handling apparatus of the production system for handling the preferably sheet-like products and is usually placed upstream of it. It is, however, in principle conceivable that a detection apparatus is responsible for multiple handling apparatuses that are preferably placed downstream from it.

The time delay device can take the form of a buffer in which multiple messages concerning the references of the products can be stored temporarily and combined. After a defined period of time, the buffer sends the message packet to the processing unit.

A server that provides services of monitoring and controlling the production system can be provided as the processing unit. The server forms the interface between the transportation apparatus, which predetermines the cycle frequency of the production system, and the individual handling apparatuses that need to be coordinated with the cycle of the transportation apparatus. For this purpose, the server is connected to the individual handling apparatuses by means of the transfer medium so that all the handling apparatuses can use a common transfer medium. With a monitoring and control method according to the present invention, there is essentially no need for any communication between the individual handling apparatuses. As a result, the extent of the data traffic in the transfer medium can be further reduced. The processing unit preferably maintains an overall cycle map of all the products conveyed by the transportation apparatus, from which the precise position in the transportation apparatus and the individual identity of a product can be seen. The overall cycle map can be continuously updated by the information of the message packets.

In an alternative of the present invention, the individual message packets are transmitted cyclically to the processing unit and the time delay period corresponds to a set adaptable time interval. Different detection apparatuses can thus select different time intervals, for example depending on the type of handling apparatus with which it is associated. The time interval can be adjusted according to predetermined parameters. A cyclical time delay period is selected, for example, for standard or routine message packets. For this purpose, time delay periods between 5 and 3000 milliseconds (msec), preferably between 100 and 300 milliseconds, particularly preferably between 150 and 250 milliseconds, are typically selected according to the predetermined speed of the transportation apparatus.

In another alternative, the message packets can be transmitted acyclically. The time delay period can, for example, correspond to any period of time until the transmission traffic in the transfer medium between the at least one detection apparatus and the processing unit is idle, i.e. until no messages or message packets and/or feedback messages or feedback message packets are currently being transmitted via the means or are still pending. Such a time delay period enables a message packet to be transmitted as quickly as possible to the processing unit or a feedback message packet to be transmitted back to the detection apparatus and is therefore suitable for high-priority queries, for example when anomalies are established by a detection apparatus during the transportation of the products. Such time delay periods are generally between 5 and 50 milliseconds, particularly preferably between 8 and 15 milliseconds.

In total, the time delay period according to the present invention can thus be between 5 and 3000 milliseconds, preferably between 5 and 300 milliseconds, depending on which transfer alternative is used. In the case of both alternatives, a transmission cycle for transmitting message packets can be independent of a cycle of the cyclically conveyed products, or respectively a transmission cycle frequency for transmitting message packets or feedback message packets can be independent of a cycle frequency of the conveyed, preferably sheet-like products, and essentially conforms with the data traffic in the transfer medium. Furthermore, the frequency of the transmission cycle is generally lower than the cycle frequency of the transportation apparatus at which the products or their grippers are conveyed and at which the references are recorded, or the recording frequency of references is quicker than a transmission cycle frequency of message or feedback message packets.

The feedback transmission time delay period for transmitting feedback message packets can be adapted to the variant for transferring the message packets. The transmission of a feedback message packet is preferably delayed for at least so long until a last requested feedback message packet has been transmitted. In other words, the queries from the message packet are answered in the order in which they arrived. In a detection apparatus, therefore, the second feedback message packet cannot respond to a second message packet, which was sent after a first message packet, before the first feedback message packet. As a result, feedback message packets are also prevented from being sent to a wrong detection apparatus.

According to further embodiments, the feedback message packets are not transmitted in chronological order, in other words not in the order in which they arrived. This necessitates a memory or temporary memory preferably for arriving message packets or the feedback message packets that are ready to be sent. Such a memory or temporary memory is preferably provided in the processing unit.

A copy of the transmitted message packet is preferably stored in the detection apparatus or an associated storage unit. After transmission of the feedback message packet, its individual feedback messages are associated with the individual messages according to the copy of the message packet. The information from the reference data concerning a set of grippers and the associated queries that were transmitted with a message packet are thus temporarily stored in the detection apparatus. The individual answers from the feedback message packet can be associated with the respective queries that pertain to a specific gripper. The information on each individual gripper can thus be updated quickly and reliably.

Furthermore, a detection apparatus for a group of products or the associated grippers that are pending handling in a handling apparatus can maintain a local cycle map according to the data and information from the references of the products of this group such as, for example, the actual position or the actual status of a product. This actual data and information of the local cycle map is transmitted, by means of the message packet, to the processing unit that compares them with the overall cycle map and returns the required answer data to the detection apparatus or also makes adaptations to the overall cycle map.

In summary, it can be stated that, in the case of the production of products, preferably flexible sheet-like products and in particular printed products, that are conveyed as cyclically processed products at high speed by a transportation apparatus, by combining information on multiple products into packets and the delayed exchange of information at least more or less independently of the cycle of the transportation apparatus, the quality of the products can be improved and the reliability of the production system is increased.

BRIEF DESCRIPTION OF THE DRAWINGS

Preferred embodiments of the invention are illustrated below with reference to the drawings that are provided purely for the purpose of explanation and should not be interpreted as implying any restriction. Features of the invention that become apparent from the drawings are to be considered individually and in any combination as belonging to the disclosure of the invention. In the drawings.

DETAILED DESCRIPTION OF THE INVENTION

Figure 1:
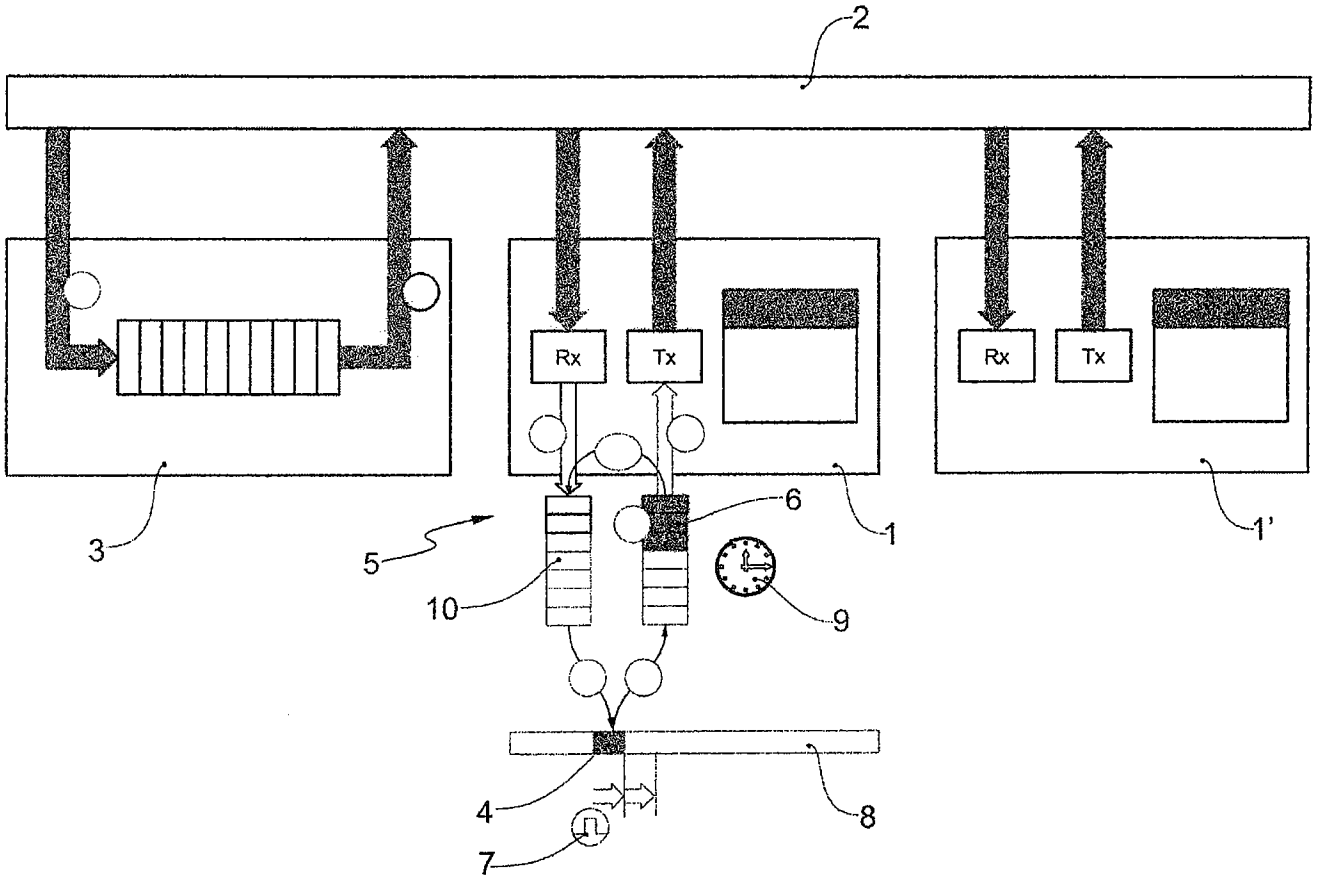
FIG. 1 shows a schematic representation of a method for monitoring and/or controlling the transportation and/or handling of multiple products.

In FIG. 1, the essential units of a system for monitoring and/or controlling the transportation and/or handling of multiple preferably sheet-like products are shown that are necessary for carrying out a method according to the present invention. Other essential components of the system are known from the prior art within the field of conveying technology for in particular sheet-like products and are therefore not illustrated for reasons of clarity. Such a system for transporting and handling or processing sheet-like products such as newspapers, magazines, etc. is known, for example, from WO 2008/144945 A2 or WO 2007/012206 A1 filed by the Applicant, the disclosure of which is included herewith in its entirety. This concerns in particular the embodiments relating to the design of a transportation apparatus for transporting sheet-like products by means of clamps or grippers, to one or more handling apparatuses for handling or processing sheet-like products, to a detection apparatus for recording references or tags, and to the design of a clamp or gripper. Other systems having a transportation apparatus and handling apparatuses such as those that can be used with the invention are known, for example, from EP 1 275 607 B1 or EP 0 897 887 B1.

According to an embodiment of the present invention, the system thus comprises a transportation apparatus, for example with an endless conveying chain, on which multiple grippers or clamps are arranged, spaced apart from one another, on which in each case a sheet-like product, for example a newspaper, is provided. The transportation apparatus transports the product in a transportation direction past two handling apparatuses, each of which is associated with a detection apparatus 1 or 1'. The detection apparatuses 1 and 1' are in contact with a processing unit, for example a server 3, by means of a transfer medium 2. The grippers are each provided with a reference 4 that serves to distinguish a product and can be read by a detection apparatus 1, 1'. The detection apparatuses 1 and 1' each comprise a time delay device, for example in the form of a buffer 5, in which messages from the gripper references 4 can be collected and combined and stored as a message packet 6.

An overall cycle map of the individual products situated in the transportation apparatus is maintained in the processing unit 3. The cycle corresponds to the first transportation cycle 7 according to the transportation speed of the transportation apparatus and at which the detection of references takes place too. Information on the individual products is deposited in the overall cycle map. For example, it is noted which production station has delivered a product to the transportation apparatus (feeder nodes) or by which handling apparatus a gripper or a product was last manipulated (access nodes). Other information is, for example, the status of the gripper, the product quality or the contents of the gripper (determining whether and in what way a product is present in a gripper), displacement of a product in a gripper, the gripping mode (for example, newspaper grasped at the spine or fore edge), position of the head of the product (to the right or the left or another orientation). The processing unit 3 consecutively assigns a consecutive code, the pace ID, for each product or each gripper. This can be used to check the transfer or inaccuracies or distortions in the transfer (so-called "electronic jitter" that is not connected with mechanical "jitter") or for splitting or joining purposes. Splitting is understood to be the dividing of a product stream into several streams, as takes place, for example, when feeding multiple destacking devices. Using joining, multiple products can, for example, be placed in a gripper.

The information in the overall cycle map can be updated with information from the product messages. In turn, a local cycle map 8 of a group of products that are currently situated at the handling apparatus of the detection apparatus and are pending handling there is created in each detection apparatus 1, 1'. The local cycle map is compared with the overall cycle map and supplemented with additional information that is relevant for the respective handling apparatus, as described below.

According to the method of the present invention, the grippers with the references 4 are guided past the detection apparatus 1 and 1' by the transportation apparatus. The subsequent procedure is described, by way of example, with the aid of the detection apparatus 1. The detection apparatus 1 records the reference and the information from the reference. In each cycle, a reference is recorded that is provided in the form of a message for the processing unit 3. The message contains, for example, information on an absolute gripper number (Grip ID) and on a position in the local cycle map 8.

The individual messages are combined in the buffer 5 or in a TX unit of the buffer to form a message packet 6 and stored for a predetermined time delay period 9. As described above, the time delay period 9 is, for example, 200 msec. The messages are preferably collected in a raw form. In addition to actual protocol data, the raw form can also contain an Invoke ID for associating a feedback message and a position in the local cycle map where this feedback message is to be entered.

After the predetermined time delay period 9 has elapsed, all the messages concerning the transported products from the buffer 5 that have accumulated are converted into a form that is suitable for transmission and combined in a message packet 6. This message packet 6 is sent to the processing unit 3 as a single large data message via the transfer medium 2. The message packet 6 is carried in the transfer medium 2 as a closed data unit. At the same time, a copy of the message packet for associating feedback messages is copied into an RX unit of the buffer 5 and stored there.

Message packets 6 of the detection apparatuses are received in the processing unit 3 and processed and answered there preferably in series. Information from the messages is thus used to update the overall cycle map, and feedback messages in response to the queries from the individual messages are written, as are instructions for processing the products. The feedback messages are combined as a feedback message packet 10. After a further time delay period, the feedback message time delay period, the feedback message packet 10 is sent to the RX unit of the buffer via the transfer medium 2. The feedback message time delay period is preferably acyclical. The message packets 6 from different detection apparatuses 1, 1' are preferably answered according to the order in which they arrived at the processing unit 3. The feedback message packet 10 is transmitted as soon as the last previous feedback message packet has been sent and the transfer medium is idle again so that there is room for the feedback message packet 10.

In the detection apparatus 1, the feedback message packet 10 is compared with the copy of the message packet 6 and the feedback messages it contains are associated with the individual messages. The information from the feedback messages is supplemented in the local cycle map and the local cycle map thus updated. The handling apparatus to which the detection apparatus 1 belongs can handle the products of the group of grippers according to the updated local cycle map and other information from the feedback message packet 10. For example, a fold can be positioned exactly, an insert incorporated into a product, or a specific label attached.

As an alternative to the cyclic transmission of message packets 6, for example respectively after a time delay period 9 of 200 msec, a message or a message packet can also be transmitted acyclically as soon as possible and hence given priority treatment. Such a message can, for example, be necessary in emergencies, for example for an emergency stop of the transportation apparatus or to shut down a handling apparatus. Such messages are sent as a priority over the cyclical message packets, specifically preferably when there is no outstanding feedback message for a last message. This can generally take place after approximately 10 msec. It is also possible hereby for multiple priority messages to be combined to form a priority message packet.

It is equally possible that urgent information from the processing unit 3 can be sent when there is no previous message from the detection apparatus for a handling apparatus. Such an information message can, for example, be sent to an RX port of the detection apparatus or the handling apparatus. Coordination of the RX port was given to the processing unit when the individual handling apparatuses were registered at the processing unit. Such information messages are usually standardized for the processing units.

Figure 2:
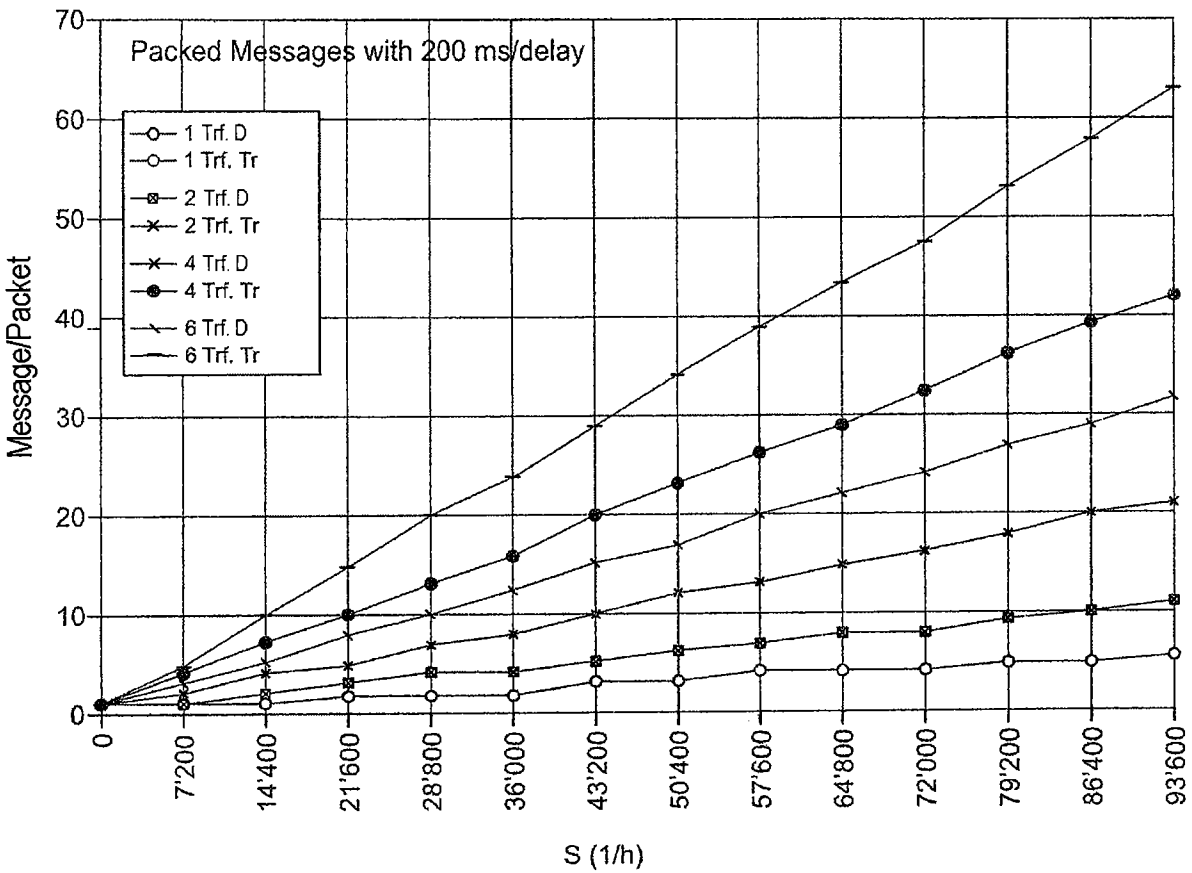
FIG. 2 shows a graph representing the number of messages transferred per unit time.

A graph is shown in FIG. 2 to illustrate the communication between detection apparatuses of the handling apparatuses and the processing unit 3 as a function of the volume of data and the cycle speed of the transportation apparatus. A splitter control system is used in the example shown. In the case of four detection apparatuses or transfer units and a speed of 43,200 product units per hour, for example approximately 20 individual messages are combined in a single message packet, when a transmission is triggered. Therefore only five message packets per second are sent to the processing unit from a detection unit. If there were no time delay period for sending the messages and combining the messages to form message packets, approximately 100 messages per second would arrive at the processing unit, i.e. a considerably larger volume of data to be processed.

The method according to the present invention thus improves the control and handling of products during transportation through a production system according to the invention with respect to both the product quality and quantity, and allows products to be combined into groups and detected as new units, which has proved to be advantageous in particular when products are sorted and packed.

The invention claimed is:

1. A method for monitoring and/or controlling the transportation and/or the handling of products, the method comprising:

associating each of the products with a reference (4), conveying the products by a transportation apparatus one after the other, preferably spaced apart from one another, in a transportation direction, guiding by the transportation apparatus past at least one detection apparatus (1, 1') that records the reference (4) and transmits a message associated with the reference to a processing unit (3), combining multiple messages concerning references (4) of the products during a time delay period (9) to form a message packet (6), wherein the time delay period (9) is between 5 and 3000 msec, and transmitting the message packet (6) to the processing unit (3) after the time delay period has elapsed.

2. The method as claimed in claim 1, wherein the products are flexible sheet-like products, preferably printed products.

3. The method as claimed in claim 1, wherein requests are made of the processing unit (3), by means of the message packet (6), for feedback messages concerning information on multiple products.

4. The method as claimed in claim 1, wherein multiple feedback messages are combined to form a feedback message packet (10), wherein each feedback message is associated unambiguously with a message.

5. The method as claimed in claim 1, wherein a feedback message packet (10) is transmitted to the detection apparatus (1, 1') after a further time delay period has elapsed.

6. The method as claimed in claim 5, wherein the further time delay period for transmitting feedback message packets (10) elapses as soon as a last requested feedback message packet has been transmitted.

7. The method as claimed claim 1, wherein a copy of the transmitted message packet (6) is stored in the detection apparatus (1, 1') and, after the feedback message packet (10) has been transmitted, its individual feedback messages are associated with the individual messages corresponding to the copy of the message packet.

8. The method as claimed in claim 1, wherein a detection apparatus (1) is associated with a handling apparatus for handling the products, and the handling apparatus is controlled as a function of information from the feedback message packets (10).

9. The method as claimed in claim 1, wherein the time delay period (9) corresponds to a set adaptable time interval.

10. The method as claimed in claim 1, wherein the time delay period (9) corresponds to a period of time until the data traffic in a transfer medium (2) between the at least one detection apparatus (1, 1') and the processing unit (3) is idle.

11. The method as claimed in claim 1, wherein the time delay period (9) is between 5 and 300 msec.

12. The method as claimed in claim 1, wherein a transmission cycle frequency for transmitting message packets (6) is independent of a cycle frequency (7) of the cyclically conveyed products.

13. The method as claimed in claim 1, wherein multiple handling apparatuses request feedback messages from the processing unit via a common transmission medium (2), wherein there is no communication between the multiple handling apparatuses.

14. The method as claimed in claim 1, wherein the processing unit establishes an overall cycle map of the products conveyed by the transportation apparatus and a local cycle map of a handling apparatus is compared with that part of the overall cycle map that relates to the handling apparatus by means of the feedback messages.

15. A system for monitoring and/or controlling at least one handling apparatus for handling multiple products in accordance with the method as claimed in claim 1, wherein each of the products is associated with a reference (4), comprising:

a transportation apparatus for transporting multiple products in succession in a transportation direction to at least one handling apparatus or past it, wherein the products are preferably sheet-like products, at least one detection apparatus (1, 1') at least for recording references of the products and for transmitting messages pertaining to the references, and at least one processing unit (3) for processing the messages, wherein at least one time delay apparatus (5), in which multiple messages concerning references (4) of multiple products are combined to form a message packet (6), and a transmission medium (2), via which the message packet (6) can be transmitted to the processing unit (3) after a time delay period (9) has elapsed, are provided.

16. The system as claimed in claim 15, wherein the transportation apparatus includes multiple grippers that are arranged on a conveying chain and grip the products detachably.

17. The system as claimed in claim 16, wherein the references are provided on the grippers of the transportation apparatus for gripping a product.

18. The system as claimed in claim 17, wherein the cycle frequency (7) at which the grippers are conveyed corresponds to the cycle frequency of recording the references by means of the at least one detection apparatus (1, 1') and is quicker than a cycle frequency at which message packets (6) are transmitted to the processing unit.

19. The system as claimed in claim 15, wherein a handling apparatus for handling the products comprises in each case one detection apparatus (1) or is associated with a detection apparatus (1).

20. The system as claimed in claim 15, wherein a message comprises at least information about the identity of a gripper and/or a position in a local cycle map of a handling apparatus.

21. A method for monitoring and/or controlling the transportation and/or the handling of products, the method comprising:

associating each of the products with a reference (4), conveying the products by a transportation apparatus one after the other, preferably spaced apart from one another, in a transportation direction, guiding by the transportation apparatus past at least one detection apparatus (1, 1') that records the reference (4) and transmits a message associated with the reference to a processing unit (3), combining multiple messages concerning references (4) of the products during a time delay period (9) to form a message packet (6), transmitting the message packet (6) to the processing unit (3) after the time delay period has elapsed, and wherein a copy of the transmitted message packet (6) is stored in the detection apparatus (1, 1') and, after the feedback message packet (10) has been transmitted, its individual feedback messages are associated with the individual messages corresponding to the copy of the message packet.

22. A method for monitoring and/or controlling the transportation and/or the handling of products, the method comprising:

associating each of the products with a reference (4), conveying the products by a transportation apparatus one after the other, preferably spaced apart from one another, in a transportation direction, guiding by the transportation apparatus past at least one detection apparatus (1, 1') that records the reference (4) and transmits a message associated with the reference to a processing unit (3), combining multiple messages concerning references (4) of the products during a time delay period (9) to form a message packet (6), transmitting the message packet (6) to the processing unit (3) after the time delay period has elapsed, and wherein multiple handling apparatuses request feedback messages from the processing unit via a common transmission medium (2), wherein there is no communication between the multiple handling apparatuses.

23. A method for monitoring and/or controlling the transportation and/or the handling of products, the method comprising:

associating each of the products with a reference (4), conveying the products by a transportation apparatus one after the other, preferably spaced apart from one another, in a transportation direction, guiding by the transportation apparatus past at least one detection apparatus (1, 1') that records the reference (4) and transmits a message associated with the reference to a processing unit (3), combining multiple messages concerning references (4) of the products during a time delay period (9) to form a message packet (6), transmitting the message packet (6) to the processing unit (3) after the time delay period has elapsed, and wherein the processing unit establishes an overall cycle map of the products conveyed by the transportation apparatus and a local cycle map of a handling apparatus is compared with that part of the overall cycle map that relates to the handling apparatus by means of the feedback messages.

* * * * *